United States Patent [19]

Hisey

[11] Patent Number: 4,697,500

[45] Date of Patent: Oct. 6, 1987

[54] ADJUSTABLE CHIMNEY CAP SUPPORT

[75] Inventor: Durward A. Hisey, St. Louis, Mo.

[73] Assignee: Hy-C Company, Inc., St. Louis, Mo.

[21] Appl. No.: 844,871

[22] Filed: Mar. 27, 1986

[51] Int. Cl.[4] ..... F23J 13/08

[52] U.S. Cl. ..... 98/67; 98/83; 98/122

[58] Field of Search ..... 55/505; 98/59, 67, 83, 98/122; 110/119

[56] References Cited

U.S. PATENT DOCUMENTS

| | | | |
|---|---|---|---|
| 533,995 | 2/1895 | Mackert | 98/67 |
| 1,622,431 | 3/1927 | Feigenbaum | 98/67 |
| 3,921,509 | 11/1975 | Curry et al. | 98/59 |
| 4,334,460 | 6/1982 | Simmons et al. | 98/67 X |
| 4,549,473 | 10/1985 | Alexander et al. | 98/67 |

FOREIGN PATENT DOCUMENTS

| | | | |
|---|---|---|---|
| 365861 | 1/1932 | United Kingdom | 55/505 |

*Primary Examiner*—Harold Joyce
*Attorney, Agent, or Firm*—Paul M. Denk

[57] ABSTRACT

A chimney cap for mounting onto a residential or building flue, including a cover, incorporating inclined flanges around its perimeter, for discharging of any elements exposed thereto. The cover being held by brackets a fixed distance above the upper edge of the chimney flue, and in co-operation with clamp means tightly securing the brackets, and the entire cover, onto the identified flue. A foraminous member in the nature of screen or wire may be draped around the braces and extending downwardly for connecting to or even slightly overlapping of the chimney flue, and being held in position by means of holding devices, in order to also prevent the entrance of any animals, rodents, birds, or the like, undesirably into the chimney. The clamp as formed is either a single or double angled clamp, with one part of the angle designed for embracing and tightly securing onto the upper edge of the chimney flue, while the integral and upper disposed angle cooperates with for tightening against the brace through the securement of a fastener for binding against opposite upper edge surfaces of the chimney flue.

7 Claims, 15 Drawing Figures

ADJUSTABLE CHIMNEY CAP SUPPORT

BACKGROUND OF THE INVENTION

This invention relates generally to the mounting of a chimney cap upon its chimney flue, but more specifically pertains to a new style of clamp means that cooperates with braces for adjustably holding a cap to the chimney flue, while simultaneously supporting the foraminous means or screen that prevents the entrance of birds, or the like, into the same.

A great variety of caps have been provided for the chimney flue, primarily for the purpose of reducing the entrance of the elements into the flue, such as snow, rain, or the like, and which can have a deleterious effect upon the chimney structure, while in addition, such caps normally incorporate some form of screen in order to prevent of squirrels, raccoons, birds, and the like, therein, and which have a tendency to block the flue and reduce or eliminate its effective operations.

Normally, most of these chimney caps, or covers, are designed including a form of exterior strap that is used for tightening of the wire screen securely about the exterior upper edge of the chimney flue, and while these type of caps may be effective for achieving their intended purposes, and to provide some degree of coverage for the upper end of the chimney flue, they leave something to be desired with respect to the ability of such caps to be adjusted in their mountings so as to be accommodated and secure upon flues of differing size.

On the other hand, such prior art chimney caps have been effective in their operations, and normally are constructed incorporating appendages that provide for the forced insertion of the cap onto the flue, with the interior resistance provided by the appendages allowing for the secure and reasonable mounting of the cap onto the chimney once installed. As an example, such a chimney cap is shown in the U.S. Pat. No. 4,535,686, issuing to the same inventor herein. A related type of cap is shown in the U.S. Pat. No. 4,534,280 to Hisey. A cap of the design having a cover and foraminous means arounds its perimeter is also shown in the U.S. Pat. No. D. 276,543 to Hisey.

One of the early embodiments of the applicant herein for mounting of his chimney cap upon a flue is shown in the U.S. Pat. No. 4,436,021, wherein adjustable fastener means or tap screw securing with band means would force a flexible strap into contact with the upper edge of the chimney flue for securing the cap in place.

Other U.S. patents showing various types of supports for holding the chimney hood in place are disclosed in the U.S. Pat. No. 4,334,460, to Simmons. In addition, U.S. Pat. No. 2,976,796, to Anthony, et al., shows a chimney cap wherein internal biasing of spring-like means holds the cap upon its chimney flue. Related type of structure is shown in the U.S. Pat. No. 2,805,616, to Roth.

Other United States patents disclosing various types of chimney caps include the Pat. No. 377,508, to Wright, in addition to the Pat. No. 2,536,235, to Steelman, et al. Likewise, other United States patents including Nos. 44,182, 197,150, 281,645, 312,918, 841,660, 1,622,431, 2,805,616, and 2,976,796, and the U.S. Pat. No. 4,334,460, disclose related types of structures for mounting of usually chimney caps upon their flues.

Other state of the art type of chimney caps include a basket shaped screen means having a cover theron, with resilient flanges provided at their bottom for biasing against the interior of the flue as the chimney cap is forced into position. In addition, another state of the art type of chimney cap means includes a cap, screen member extending downwardly therefrom, and attaching clamps extending downwardly from the cover and having a threaded fastener extending inwardly therefrom and each having a J clamp mounted thereon for securing with the upper extending edge of the chimney flue. This latter cap, during its installation, as can be readily determined, is rather weak in structure, primarily because the entire cap, its screen member, and the bracing is simply held suspended exteriorly of the chimney flue by means of four of the J clamps, and the lengthy threaded fasteners extending inwardly from the bottom of the cap struts.

It is, therefore, the principal object of the this invention to provide a chimney cap of stable construction incorporating a series of clamp means co-operating with braces for stabily mounting of the cap upon the upper edge of a chimney flue.

Another object of this invention is to provide the use of clamps that co-operate directly with the bottom of the cap bracing for securing directly onto the chimney flue, rather than suspending the cap in place as is done in other select prior art devices.

A further object of this invention is the co-operation of a double angled clamp, threadily connected directly with the bottom edge of each brace extending downwardly from the chimney cap, for providing a direct mounting onto the upper edge of the chimney flue and through tightening of its threaded member securing firmly and intermediately thereof tightly upon the upper edge of the chimney flue.

Still another object of this invention is to provide a chimney cap incorporating a minimum of metallic or otherwise components that provide both stable mounting of the cap upon the chimney flue, while at the same time having built-in adjustablility so as to accommodate flues of differing size and diameter.

Still another object of this invention is to provide a chimney cap for a flue and which can be disassembled for ease of storage, shipment, and display, but which can be promtly assembled for ready installation onto chimney flues of differing sizes.

Yet another object of this invention is to provide a chimney cap wherein its structural components can be easily mounted onto the top of a chimney flue, and then the homeowner can readily install his own available screen, wire, or foraminous means with ease in its tightening and wrapround the flue, and with the cap being readily clamped in place for permanent installation.

These and other objects will become more apparent to those skilled in the art upon reviewing the summary of this invention, and upon undertaking a study of the description of its preferred embodiment, in view of the drawing.

SUMMARY OF THE INVENTION

This invention includes the formation of a chimney cap incorporating a cover that is displaced upwardly above the chimney flue at a fixed distance, through the agency of a series of braces, and then foraminous means in the nature of wire, screen, or the like, is wrapped around in order to complete the cap installation. In its structural fabrication, a series of lineal bracings extended downwardly from the cover, with the upper ends of the bracing bent inwardly, and normally including a slot therein, and through a which a fastening means may insert for tightly securing the bracing to its cap. Obviously, because of the slotted nature of the bracing, or more specifically at its upper ends, the mounting of the bracings with respect to the cover can be adjusted, whether inwardly or outwardly, in order to accommodate a wider range of chimney flues upon which the cap may be mounted. At their downward ends, each brace has connecting therewith a clamp means, generally preferably fabricated as an angle, or as a double angle, with the clamp means being normally arranged either exteriorly or interiorly of each brace end, and having an approximate width there between said angle and the brace to provide for the insertion of the upper edge of the chimney flue intermediate thereof. Then, upon tightening of a cooperating fastener, the clamp means will be drawn towards its corresponding braces downward end and tightly bind against the upper edge surfaces of the adjacent flue. As stated, each clamp means may be formed as a double bend angle, with the lowermost angle being arranged for inserting onto and securing the chimney flue therein, while the uppermost angle, which may be of smaller dimension, has the fastener inserting therethrough and functioning as a tightening means useful for securing the entire cap onto the residential or building chimney.

DESCRIPTION OF THE PREFERRED EMBODIMENT

Figure 1:
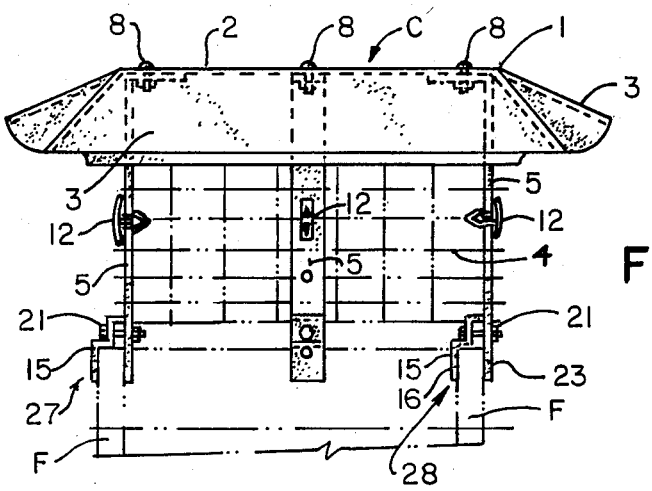
FIG. 1 provides a side view of the chimney cap of this invention incoporating its cover, screen, and bracing useful for clamping the cap onto the upper edge of the chimney flue, which is identified in phantom line.

In referring to the drawings, and in particular FIG. 1, there is disclosed the chimney cap C of this invention. As shown, it includes a cover 1 which generally incorporates a flattened upper surface 2 having a series of downwardly canted edges, as at 3, and useful for providing for drainage of the elements from the cap, after its installation upon a chimney flue. The chimney flue is shown in phantom line at F and it is this particular flue for which the installation of this cap is intended to prevent the entrace of inclement weather, such as rain or snow. Also, as can be noted, the cover is displaced some distance above the upper edge of the chimney flue, in order to provide for sufficient draft for attracting the vented gases, smoke, and the like, from the associated furnace or fireplace, and for venting to the atmosphere. This particular space between the cap C, and the flue tile, is intended for installation of a foraminous member, as at 4, in order to prevent the entrance of any animals, birds, or the like, into the chimney, and which may otherwise block its designed draft.

Figure 2:
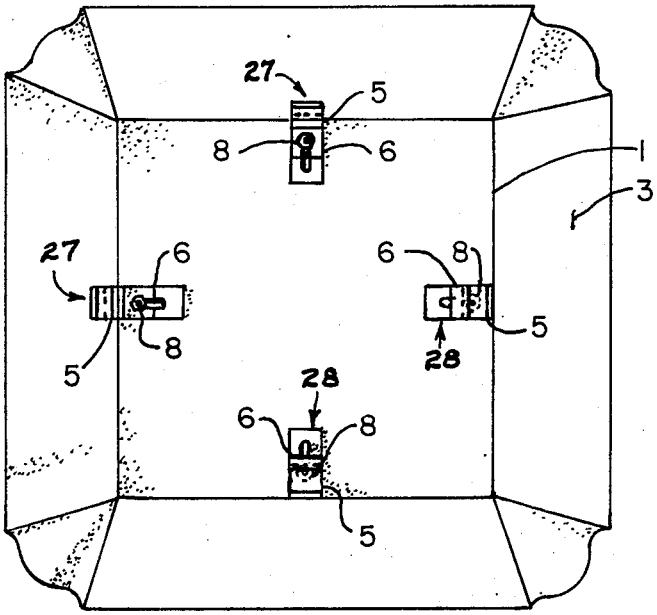
FIG. 2 is a bottom view of the invention.
Figure 3:
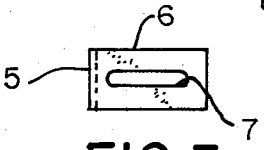
FIG. 3 is a top view of one of the braces, showing its inturned slotted upper edge thereof.

As can also be seen in FIGS. 1 and 2, there are a series of braces 5, there being four in number, provided mounting with the underside of the cover 1, with each of the braces extending generally downwardly from approximately a side edge of the cover where it breaks into its flanged or canted edges. As noted, each brace 5 has an upper inturned edge, as at 6, which extends for some distance contiguously with the underside of the cap cover, and as can be noted in FIG. 3, each inturned edge is formed having a slot, as at 7, and through which the fastening means 8 may secure for holding the braces firmly to the cover C. In any event, the bracings will be tightened into their fixed position after the dimensions for the flue will have been determined, and the slotted inturned edges 6 for the said bracings will have been located at those positions necessary to provide for the aligned mounting of the cover onto the upper edge of the chimney flue. Obviously, it can be seen that the length of the slot 7 provided within each brace allows some degree of adjustment in the mounting of the chimney cap upon flue tiles of differing sizes and diameter, whether the flues be of annular design, or of oval, rectangular or of square configurations. In addition, the edges 6 may be turned inwardly, as shown, or they may also turn outwardly, to add greater variation in the dimension of the flue F upon which the cap may mount.

Figure 4:
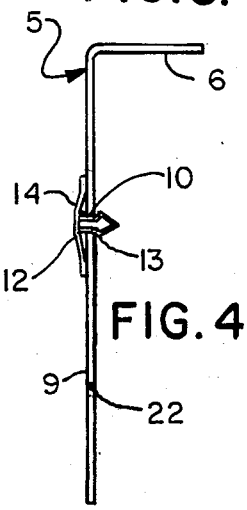
FIG. 4 is a side view of a brace.
Figure 5:
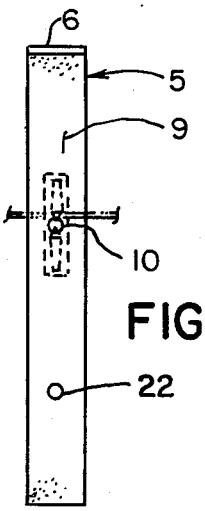
FIG. 5 is an inner view of the brace of FIG. 4, as viewed from the right.

The particular braces of this invention are shown in FIGS. 4 and 5, and as can be seen, each brace 5 includes a length, as at 9, and that sufficient distance to provide the designed displacement of the cap cover at some distance above the flue upon which it is intended to be installed. In addition, the inturned upper ends 6 will also be of sufficient distance so as to dispose its slot for proximity fitting, and securement there against, of the underside of the cover 1. There are a series of apertures, as at 10, provided through the vertical portion of each brace, and these are intended to have a holding means, one is shown at 12, such as a Timmerman fastener, that snaps into engagement therein, in order to provide a quick and rapid means for installation of the foraminous member, or the screen 4, to the cap, during and after its installation. These type of holding means include a compressible stem portion 13, integrally formed with a lengthy base member 14, the latter intended to overlie a series of adjacent strands for the wire to be secured and firmly held into position against the bracing 5, after the foraminous member 4 is installed in place.

Figure 6:
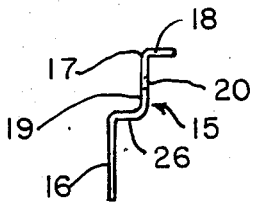
FIG. 6 is a side view of an anlged clamp means.
Figure 7:
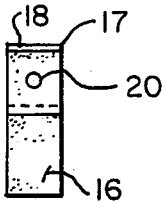
FIG. 7 is an interior view, as taken from the right, of the clamp means of FIG. 6.
Figure 8:
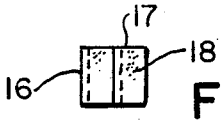
FIG. 8 is a top view of the clamp means of FIG. 6.
Figure 9:
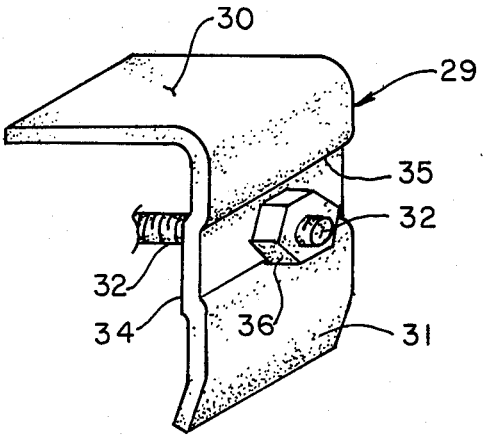
FIG. 9 is an isometric view of another angled clamp means of this invention.
Figure 10:
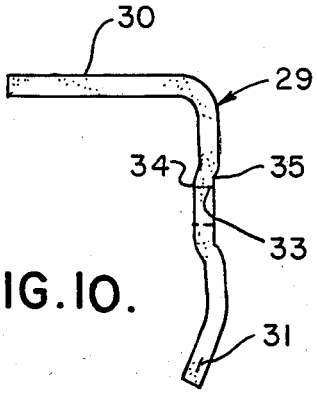
FIG. 10 is a side view thereof.
Figure 11:
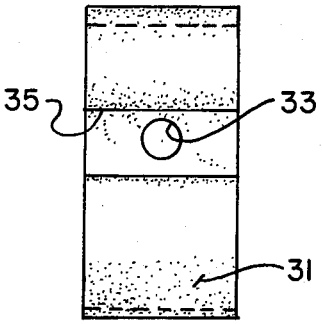
FIG. 11 is a front view thereof.
Figure 12:
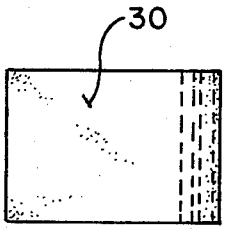
FIG. 12 is a top view thereof.
Figure 14:
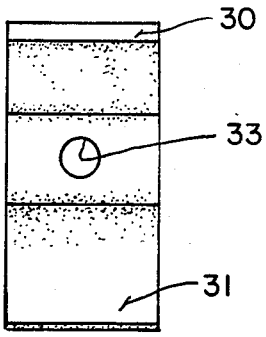
FIG. 14 is an interior view of the clamp means of FIG. 9.
Figure 13:
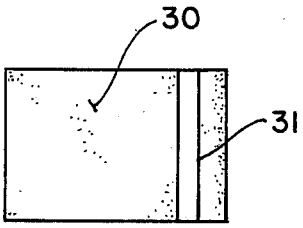
FIG. 13 is a bottom view thereof.
Figure 15:
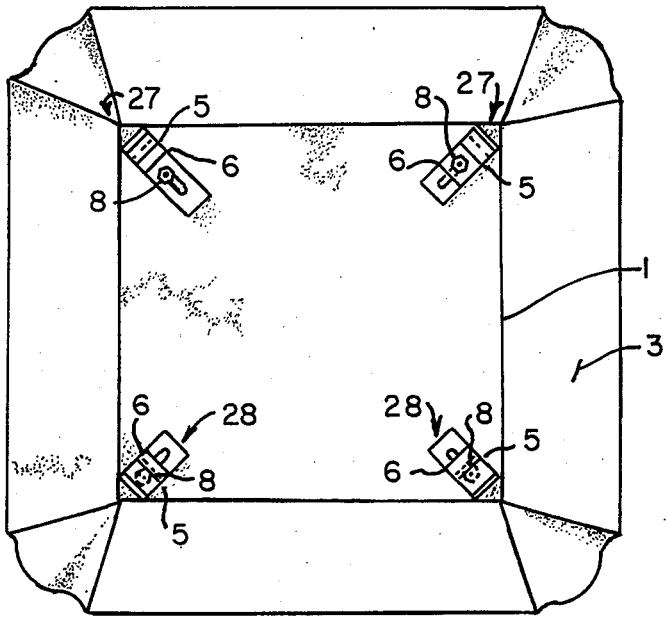
FIG. 15 is a bottom view of the invention showing the braces located at each corner of the cover means.

The securement of the entire chimney cap upon the flue is effected through the application of a series of clamp means, such as disclosed in FIGS. 6 through 8, and in FIGS. 9 through 14. These clamp means 15 are generally configured as bent angle members, preferably single or double angled members, as can be seen. In the double angled member, its downward shaped angle 16 is disposed for embracing against the upper edge of the chimney flue, as can be seen in FIG. 1. The integrally formed and upper extending angle portion 17 includes a pair of legs, the upper leg is bent into a horizontal position, as at 18, and is intended to bias against the brace to which the clamp is installed. The downwardly extending leg 19 is provided with an aperture therethrough, as at 20, and through which a fastener 21 is installed. As can be seen, the aperture 20 is formed in alignment with a similar type of aperture 22 formed through the vertically disposed leg 9 of the brace 5, so that when each fastener 21 is tightened, after the insertion of the cap into position upon the chimney flue, the upper edge of the flue is arranged intermediate the angle 16, and the adjacent downward portion of the brace 5, as at 23 (See FIG. 1), and the fastener 21 may then be tightened, so that the cap will be firmly held into position pemanently upon the chimney flue. The chimney flue will have the cap firmly installed thereon, with the upper edge of the flue coming to rest against of the formed shoulder, as at 26, conveniently provided within the shaped configuration of the formed clamp 15.

As can be noted in FIGS. 1 and 2, there are various methods disclosed for installation of the clamp means to its adjacent brace 5. For example, as can be seen at the left side and top of the cap, as shown at 27, the clamp means is disposed outwardly of its co-operating brace 5, for installation ontl the chimney flue. On the other hand, as can be seen at the right hand side and front of the same figures, as at 28, the clamp means is preferably installed interiorly of the brace 5, or its lower segment 23, and this particular arrangement is the preferred method for assembly, since the clamp means, and its fastener 21, will generally be arranged interiorly of the chimney cap, proximate the upper inner edge of the chimney flue, and thereby be relatively free of exposure to the elements so as to prevent any untimely or accelerated deterioration of the same. In any event, as can be noted, there will be approximately four combinations of braces 5 and the associated clamp means 15, for securing at four discrete locations around the perimeter of the upper edge of the residential or building chimeny flue. And, as can further be noted, generally these brace means will secure proximate the side edges of the upper flattened portion for the chimney cover 1. Or in the alternative, these braces and clamps may just as likely be installed at the corners, and yet function to provide the same desirable shelter for the chimney and its flue against the entrance of the elements, or the like.

As can also be seen in FIG. 9 through 14, another preferred method of construction for the clamp means of this invention is shown. As disclosed, the clamp means in this particular instance would be used as a replacement for the clamp means 15 as previously explained, but function for the same purpose. As herein disclosed, the clamp means 29 comprises a single bent clamp means formed of two legs, a horizontally extending leg 30, and a downwardly depending leg 31. When mounted into position for usage, it will have its fasteners 32 extending leg 30, and a downwardly depending leg 31. When mounted into position for usage, it will have its fasteners 32 extending through the aperture 33, as shown, and also extending through the aperture 22, provided through the vertically disposed brace leg 9, as previously explained. Thus, when in that position, the clamp, when its fastener 32 is tightened, will be tightly secured upon the upper edge of the flue tile F, as previously explained, with the downwardly depending leg 31 of the angled clamp 29 tightly binding, with the downward portion 23 of the brace leg, against the upper edge of the flue tile, to secure it firmly in place. The horizontal arrangement of the fastener 32 will function as an upper stop against which the upper edge of the flue tile F will encounter, so as to limit the extent of insertion of the flue tile between the angle leg 31, and the brace 9, as explained. In addition, it can be seen that the downwardly depending leg 31 of the angle member 29 incorporates a bend therein, as at 34, and which forms a shallow external channel 35, and the fastening means, or more specifically its nut 36, is intended for positioning therein so as to prevent its turn while the fastening member 32 is being tightend into position. This is to facilitate the installation of this adjustable chimney cap means onto the upper edge of the flue tile, during installation. Thus, once again, as previously explained, this angled clamp 29 may be located either interiorly of the brace 9, as can be seen at 28 in FIG. 1, or in the alternative, it may be located exteriorly of the brace 9, as shown at 27 also within the same Figure.

Variations or modifications to the subject matter of this invention may occur to those skilled in the art upon reviewing the description of the embodiment herein. Such variations or modifications, if within the spirit of this invention, are intended to be encompassed within the scope of any claims to patent protection issuing upon this invention. The description of the preferred embodiment set forth herein is done so primarily for illustrative purposes only.

Having thus described the invention what is claimed and desired to be secured by Letters Patent is:

1. In a chimney cap of the type designed for installation upon a chimney flue and useful for restraining the entrance of inclement weather, animals, birds, and the like, into the same chimney, said cap being of the type having a cover disposed for mounting a spaced distance above the chimney and incorporating a foraminous member such as a screen arranged below the cover and approximately surrounding and in line above the flue for achieving the aforesaid restraining purposes, the improvement which comprises, a series of braces connecting with the underside of said cover, fastening means securing the braces to said cover, said braces extending approximately downwardly from the cover and for mounting upon the chimney flue, holding means securing the foraminous member to the braces, clamp means securing with the proximate downward ends of the braces for securing the braces and the cover to the chimney flue, each clamp means including an angled member incorporating at least a pair of legs, one leg disposed for biasing against a brace, and the other leg extending downwardly for mounting against an upper side edge of the chimney flue while the approximate lower part of the cooperating brace biases against the opposite edge of the chimney flue, the upper edges of the chimney flue being secured intermediate each pair of combined lower brace portion and the clamp means, a fastener arranged for tightening clamp means to its proximate brace for installation of the chimney cap upon its associated flue, there being four braces provided connecting with the cover means, along each side thereof, the clamp means securing through the fastener to each approximate downward portion of each brace for securing the chimney cap to its flue, each clamp means being a double angled member, one angle integrally formed above and staggered with respect to the other angle, the downward angle disposed for cooperating with the connecting brace for securing upon the upper edge of the chimney flue, while the upper angle cooperates with the fastener and brace for tightening of the clamp means to the flue.

2. In a chimney cap of the type designed for installation upon a chimney flue and useful for restraining the entrance of inclement weather, animals, birds, and the like, into the said chimney, said cap being of the type having a cover disposed for mounting a spaced distance above the chimney and incorporating a foraminous member such as a screen arranged below the cover and approximately surrounding and in line above the flue for achieving the aforesaid restraining purposes, the improvement which comprises, a series of braces connecting with the underside of said cover, fastening means securing the braces to said cover, said braces extending approximately downwardly from the cover and for mounting upon the chimney flue, holding means securing the foraminous member to the braces, clamp means securing with the proximate downward ends of the braces for securing the braces and the cover to the chimney flue, each clamp means including an angled member incorporating at least a pair of legs, one leg disposed for biasing against a brace, and the other leg extending downwardly for mounting against an upper side edge of the chimney flue while the approximate lower part of the cooperating brace biases against the opposite edge of the chimney flue, the upper edges of the chimney flue being secured intermediate each pair of combined lower brace portion and the clamp means, a fastener arranged for tightening each clamp means to its proximate brace for installation of the chimney cap upon its associated flue, there being four braces provided connecting with the cover means, at each corner thereof, the clamp means securing through the fastener to each proximate downward portion of the brace for securing the chimney cap to its flue, each clamp means being a double angled member, one angle integrally formed above and staggered with respect to the other angle, the downward angle disposed for cooperating with the connecting brace for securing upon the upper edge of the chimney flue, while the upper angle cooperates with the fastener and brace for tightening of the clamp means to the flue.

3. The invention of claims 1 or 2 and wherein there being aligned apertures provided through the upper angle and the adjacent brace, and the fastener extending therethrough and upon tightening securing the cap to the chimney flue.

4. The invention of claim 3 and wherein each clamp means being arranged interiorly of its respective brace.

5. The invention of claim 3 and wherein each clamp means being arranged exteriorly of its cooperting brace.

6. The invention of claim 3 and wherein each brace means having an inturned upper edge, and the fastening means securing the inturned upper edge to the cover.

7. The invention of claim 6 wherein each inturned upper edge of the brace having a slot provided therethrough, and through which the fastening means inserts, to provide for adjustment in the arrangement of the braces in their downward extension from the chimney cap and for accommodating their mounting onto differing sized flues.

* * * * *